US008151468B2

(12) United States Patent
Schulz

(10) Patent No.: US 8,151,468 B2
(45) Date of Patent: Apr. 10, 2012

(54) HANDLE FOR SHAVING RAZORS HAVING IMPROVED GRIP

(75) Inventor: Kristopher William Schulz, Framingham, MA (US)

(73) Assignee: The Gillette Company, Boston, MA (US)

( * ) Notice: Subject to any disclaimer, the term of this patent is extended or adjusted under 35 U.S.C. 154(b) by 638 days.

(21) Appl. No.: 12/238,886

(22) Filed: Sep. 26, 2008

(65) Prior Publication Data

US 2010/0077622 A1 Apr. 1, 2010

(51) Int. Cl.
*B26B 21/00* (2006.01)

(52) U.S. Cl. ..... 30/50; 30/526

(58) Field of Classification Search ..... 30/526, 30/50, 32; 16/430; D28/44–54
See application file for complete search history.

(56) References Cited

U.S. PATENT DOCUMENTS

| | | | | | |
|---|---|---|---|---|---|
| 4,949,457 | A * | 8/1990 | Burout, III | ..... | 30/526 |
| 5,027,511 | A * | 7/1991 | Miller | ..... | 30/526 |
| 5,497,551 | A * | 3/1996 | Apprille, Jr. | ..... | 30/526 |
| 5,784,790 | A * | 7/1998 | Carson et al. | ..... | 30/532 |
| 5,813,293 | A * | 9/1998 | Apprille et al. | ..... | 76/106 |
| 5,839,163 | A * | 11/1998 | Hellmann | ..... | 16/436 |
| 5,855,071 | A * | 1/1999 | Apprille et al. | ..... | 30/532 |
| 5,890,296 | A * | 4/1999 | Metcalf et al. | ..... | 30/526 |
| 6,273,626 | B1 * | 8/2001 | Yazawa | ..... | 401/6 |
| 6,375,373 | B2 * | 4/2002 | Izushima | ..... | 401/6 |
| 6,886,262 | B2 * | 5/2005 | Ohtsubo et al. | ..... | 30/526 |
| D566,896 | S | 4/2008 | Jung | | |
| 7,383,619 | B2 * | 6/2008 | Gross et al. | ..... | 16/430 |
| 7,861,419 | B2 * | 1/2011 | Psimadas et al. | ..... | 30/526 |
| 2005/0172493 | A1 | 8/2005 | Fischer et al. | | |
| 2007/0050996 | A1 * | 3/2007 | Schnak et al. | ..... | 30/526 |

FOREIGN PATENT DOCUMENTS

| | | | |
|---|---|---|---|
| WO | WO 2004/018163 | A1 | 3/2004 |
| WO | WO 2007/000185 | A1 | 1/2007 |

OTHER PUBLICATIONS

PCT International Search Report with Written Opinion in corresponding Int'l appln. PCT/US2009/057608 dated Jan. 1, 2010.

* cited by examiner

*Primary Examiner* — Boyer D Ashley
*Assistant Examiner* — Omar Flores Sanchez
(74) *Attorney, Agent, or Firm* — John M. Lipchitz; Kevin C. Johnson; Steven W. Miller

(57) ABSTRACT

A wet shaving razor has a handle with a substantially rigid elongated gripping section extending along a longitudinal axis of the handle. An elastomer cover is joined to the elongated gripping section and includes a plurality of flexible fins having a first section having a first width and a second section having a second width that is less than the first width. The fins have a height to gap width ratio of about 1:1 to about 2:1, such that the fins have a flexed position in which one or more of the fins deflects and contacts an adjacent fin.

18 Claims, 4 Drawing Sheets

HANDLE FOR SHAVING RAZORS HAVING IMPROVED GRIP

FIELD OF THE INVENTION

The present invention relates to handles for toiletry articles and more particularly to plastic shaving razors having a handle with one or more elastomeric grip portions.

BACKGROUND OF THE INVENTION

Shaving razor handles are often made of molded plastic. A first plastic material may be used to mold a base of the handle and a second softer plastic, such as an elastomeric material, may be molded over the base. The second softer plastic material may include ribs or other gripping members to improve feel and reduce slipping, especially in a wet environment in which lotions, gels or oils are used. An example of a shaving razor having gripping portions is illustrated in U.S. Design Pat. No. D566,896 S, which is manufactured by Dorco Co., Ltd. and is available for purchase at various KMART stores.

SUMMARY OF THE INVENTION

In one aspect, the invention features, in general, a handle for a personal grooming article including a substantially rigid elongated gripping section having a proximal end portion and a distal end portion and a plurality of substantially rigid ribs projecting from a top surface of the elongated gripping section and extending substantially perpendicular to a longitudinal axis of the elongated gripping section. A flexible cover is joined to the elongated gripping section which includes a plurality of fins and a frame interconnecting a plurality of end portions of the plurality of fins. The plurality of fins define a plurality of slots extending through the cover, wherein the fins are positioned between respective ribs of the elongated gripping section. If desired, particular embodiments may optionally include fins that are releasably joined to the elongated gripping section.

In another aspect, the invention features, in general a wet shaving razor including a handle having a substantially rigid elongated gripping section extending along a longitudinal axis of the handle. An elastomer cover is joined to the elongated gripping section and includes a plurality of flexible fins having a first width and a second width that is less than the first width. The fins have a shore A hardness of about 20 to about 40 and a height to gap width ratio of about 1:1 to about 2:1.

In another aspect, the invention features, in general a wet shaving razor including a handle having a substantially rigid elongated gripping section extending along a longitudinal axis of the handle and an elastomer cover joined to the elongated gripping section. The cover includes a plurality of flexible fins having a first section having a first width and a second section having a second width that is less than the first width. The fins have a height to gap width ratio of about 1:1 to about 2:1, such that the fins have a flexed position in which one or more of the fins deflects and contacts an adjacent fin.

DETAILED DESCRIPTION OF THE INVENTION

Figure 1:
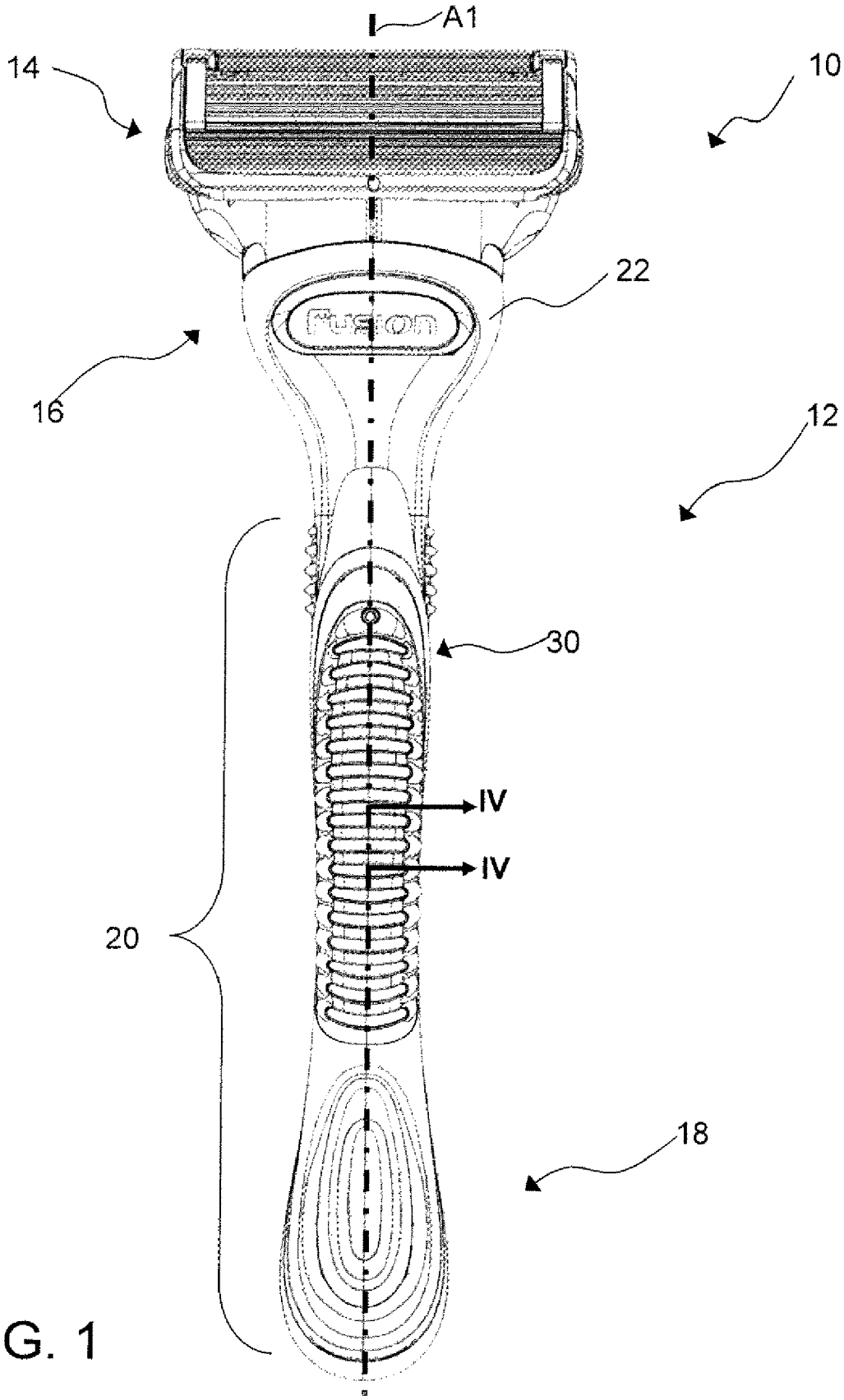
FIG. 1 is a bottom plan view of a wet shaving razor.

Referring to FIG. 1, one possible embodiment of the present disclosure is shown illustrating a shaving razor 10 having a handle 12 and a cartridge 14. In certain embodiments, the cartridge 14 may be detachably and pivotably mounted to a proximal end portion 16 of the handle 12. The cartridge 14 may be removed and discarded from the handle 12 and a new cartridge 14 may be mounted on the handle 12 as needed by a user. The handle 12 may extend along a longitudinal axis A1. An elongated base member 22 may extend from the proximal end portion 16 to a distal end portion 18 of the handle 12. The handle 12 may include an elongated gripping section 20 having a cover 30 which provides for improved wet gripping of the handle 12. As will be described in greater detail below, the handle 12 may be manufactured from several different materials to provide the user with the optimal weight, feel and function during shaving.

Figure 2:
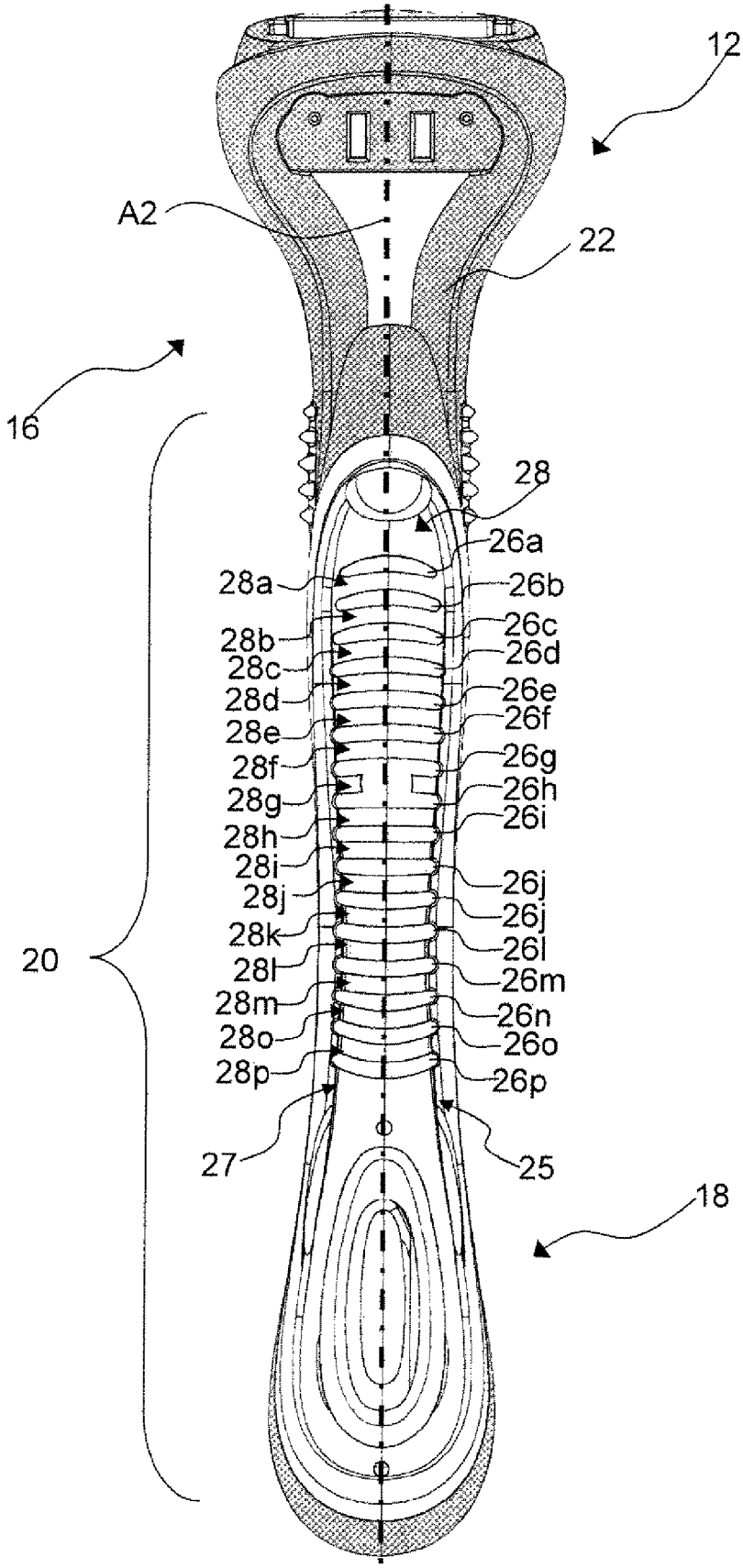
FIG. 2 is a bottom plan view of one possible embodiment of a handle which may be incorporated in the shaving razor shown in FIG. 1.

Referring to FIG. 2, a bottom plan view of the handle 12 is shown with the cover 30 removed for clarity. In certain embodiments the elongated base member 22 may be manufactured from a relatively heavy or dense material, such as a zinc alloy. Other materials may also be used such as metals, alloys, filled polymers or composites. The elongated base member 22 may give the handle a desired weight and balance. The elongated gripping section 20 may be manufactured or molded from the same material as the elongated base member 22, or a lighter material, such as an unfilled plastic may be used. The elongated gripping section 20 may be molded from a polymer that provides for slick or slippery surface. For example, the elongated gripping section 20 may be molded from polymers such as high impact polystyrene (HIPS), polypropylene (PP) and acrylonitrile butadiene styrene (ABS). The surface finish of the elongated gripping section 20 may also be smooth to increase the slipperiness of the surface, which may aid in removing water from the handle 12. The elongated gripping section 20 may be assembled to the elongated base member 22 using standard assembly procedures such as over molding, insert molding, mechanical fasteners, adhesives and various snap, latch or press fit designs.

The elongated gripping section 20 may include a plurality of ribs 26*a*-26*p* that project slightly above a top surface 28 of the elongated gripping section 20 and run substantially traverse to the longitudinal axis A1 of the handle 12. The ribs 26*a*-26*p* may also extend at least partially along one or more side walls 25 and 27 of the handle 12. The ribs 26*a*-26*p* may include a first set of bowed ribs 26*a*-26*g*, a second set of bowed ribs 26*k*-26*p* and a set of substantially straight ribs 26*h*-26*j* that are positioned between the first and second set of bowed ribs 26*a*-26*g* and 26*k*-26*p*. The first set of bowed ribs 26*a*-26*g* may be positioned toward the proximal end portion 16 of the handle 12 and the second set of bowed ribs 26*k*-26*p* may be located toward the distal end portion 18 of the handle 12. The first and second set of bowed ribs 26*a*-26*g* and 26*k*-26*p* may have an internal radius of curvature angled toward the set substantially straight ribs 26*h*-26*j*. The plurality of ribs 26*a*-26*p* may define a series of corresponding slots 28*a*-28*p*. The plurality of ribs 26*a*-26*p* and the series of slots 28*a*-28*p* may each have a generally smooth and arcuate profile along and traverse to a longitudinal axis A2 of the elongated gripping section 20.

Figure 3:
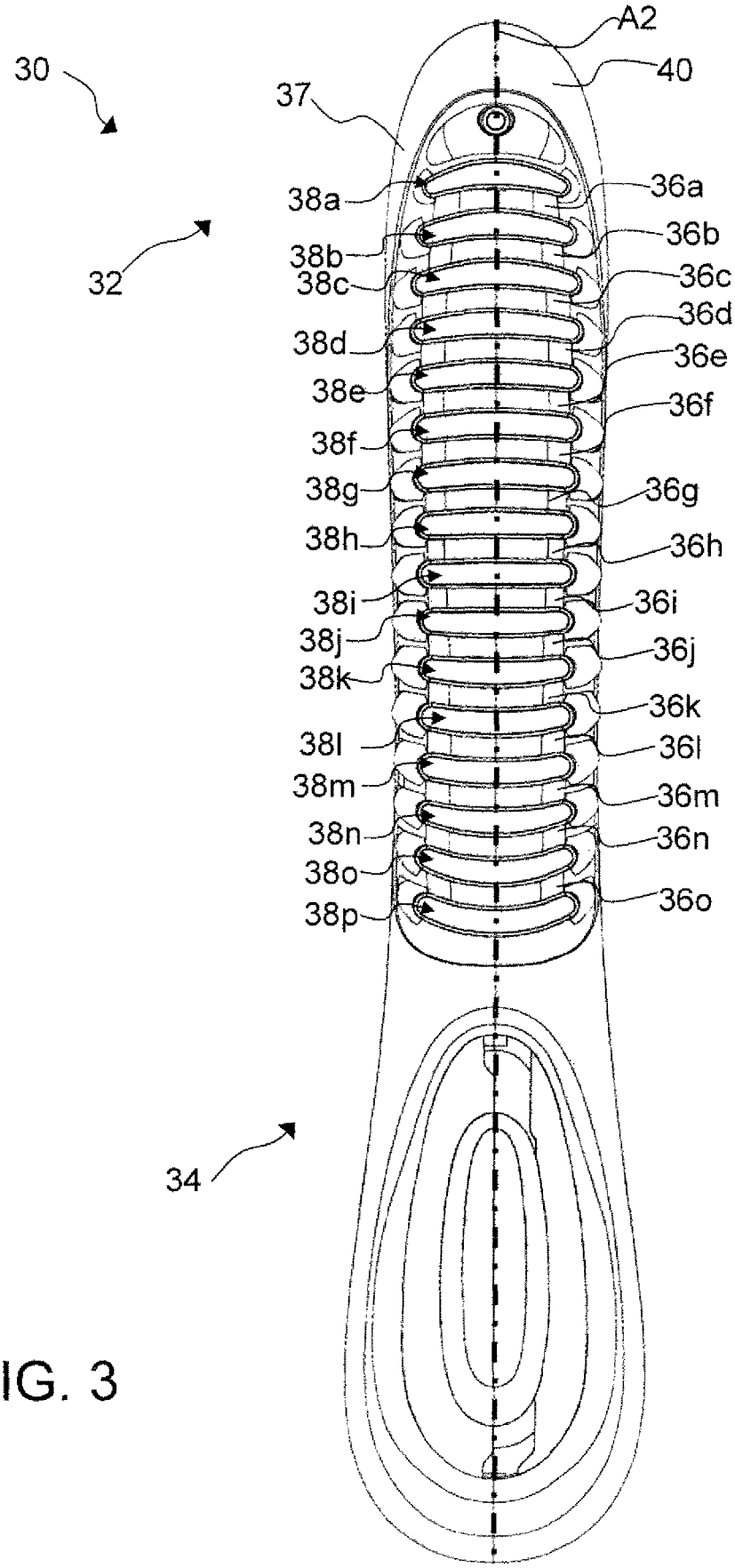
FIG. 3 is a top plan view of a cover which may be incorporated in the shaving razor shown in FIG. 1.

Referring to FIG. 3, a bottom plan view of one possible embodiment of the cover 30 is shown which may be incorporated into the handle 12 of FIG. 1. The cover 30 may be molded from a soft polymer having tacky or sticky properties, such as certain elastomers. The coefficient of friction of the cover 30 may be greater than the coefficient of friction of the elongated gripping section 20. The elastomeric cover 30 may have a shore A hardness of about 20, 30 or 40 to about 60, 70 or 80.

The elastomeric cover 30 may include a plurality of fins 36*a*-36*o* that project up from a top surface 40 of the cover 30 and extend substantially traverse to a longitudinal axis A3 of the cover 30. The fins 36 may include a first set of bowed fins 36*a*-36*g*, a second set of bowed fins 36*k*-36*o* and a set of substantially straight fins 36*h*-36*j* that are positioned between the first and second set of bowed fins 36*a*-36*g* and 36*k*-36*o*. The first set of bowed fins 36*a*-36*g* may be positioned toward a proximal end portion 32 of the cover 30 and the second set of bowed fins 36*k*-36*p* may be located toward a distal end portion 34 of the cover 30. The first and second set of bowed fins 36*a*-36*g* and 36*k*-36*o* may have an internal radius of curvature angled generally toward the set substantially straight ribs 36*h*-36*j*. The plurality of fins 36*a*-36*o* may be interconnected to one another by an enclosed frame 37 that extends around the perimeter of the lateral edges of the fins 36*a*-36*p*. The frame 37 may interconnect a plurality of end portions of the fins 36*a*-36*p*. The frame 37 may provide sufficient strength and durability while increasing the flexibility of the fins 36*a*-36*o* by eliminating an interconnection or support structure between the fins 36*a*-36*o*. The cover 30 and the plurality of fins 36*a*-36*g* may define a series of slots 38*a*-38*p* that extend completely through the top surface 40 of the cover 30. The plurality of fins 36*a*-36*o* may have a generally arcuate profile along and perpendicular to the longitudinal axis A3 of the cover 30.

One or more of the fins 36*a*-36*o* may project from the top surface 40 at an angle that is not perpendicular to the top surface 40 of the cover 30. For example the fins 36*a*-36*o* may have an angle of about 30 degrees to about 90 degrees. The fins 36*a*-36*g* may extend at an angle toward the proximal end portion 32 of the cover 30 and the fins 36*k*-36*o* may extend at an angle toward the distal end portion 34 of the cover. The angle of the fins 36 may facilitate the deflection of the fins 36.

Figure 4:
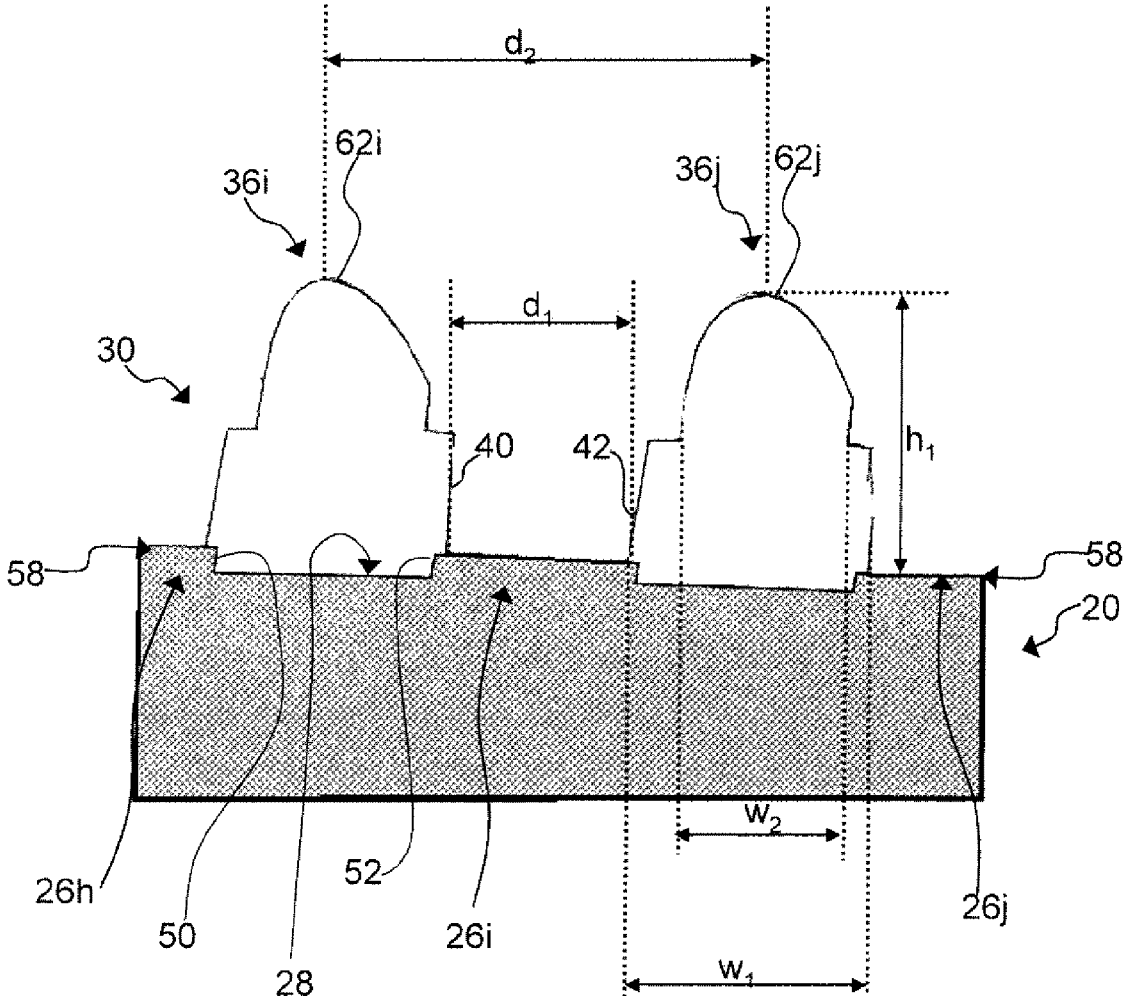
FIG. 4 is a cross section side view of a portion of the wet shaving razor, taken generally on the line IV-IV, of FIG. 1.

Referring to FIG. 4 an enlarged side cross section view of a portion of the elongated gripping section 20 is shown, illustrating fins 36*i* and 36*j*. It is understood that the fins 36*a*-36*o* may be substantially similar in structure and function, unless otherwise indicated. For purposes of clarity, only the fins 36*i* and 36*j* are shown in FIG. 4. Also only fins 36*i* and 36*j* will be described in full detail, in regards to FIG. 4, as it is understood that the other fins 36*a*-36*h* and 36*k*-36*o* have similar features, dimensions, proportions resulting in similar functions as fins 36*i* and 36*j*.

In certain embodiments the cover 30 and the elongated gripping section 20 may be manufactured using an overmolding or co-molding process in which the elongated gripping section 20 is molded first and an elastomer for the cover 30 is injection molded around the elongated gripping section 20. In other embodiments, the cover 30 may be secured or joined to the elongated gripping section 20 using other methods such as ultrasonic welding or laser welding, mechanical methods such as snap fit or press fit designs, mechanical fasteners, such as screws or pins, or even chemical methods such as adhesives. After the cover 30 is molded to the elongated gripping section 20, the elongated gripping section 20 may have an exposed top surface 58 that is substantially free the elastomeric cover 30, which may aid in wicking water and other materials, such as lubricious shaving aids, away from the cover 30, thus providing for an improved wet grip. In certain embodiments the cover 30 and the elongated gripping section 20 may be molded from polymers having different colors to allow for color differentiation between the two components, for example the elongated gripping section 20 may be clear and the cover 30 may be grey.

The fins 36 may be molded or positioned between a pair of adjacent ribs 26. For example, fin 36*i*, may be molded or positioned between the ribs 26*h* and 26*i* and fin 36*j* may be molded or positioned between ribs 26*i* and 26*j*. The ribs 26, for example ribs 26*h* and 26*i*, may have a respective side walls 50 and 52 that support and provide for increased rigidity of the fin 36*i*. The ribs, such as ribs 26*h* and 26*i* may allow for an increased surface area for the respective fin, such as fins 36*i* and 36*j*, to join or bond to. For example, the fin 36*i* may be joined or bonded at least partially to the top surface 28 of the elongated gripping section 20 as well as an exposed top surface 58 and side walls 50 and 52 of the adjacent ribs 26*h* and 26*i*. In certain embodiments the fins 36 may have a relatively weak releasable bond with the elongated gripping section 20 such that the fins 36 are releasably joined, allowing the fins 36 to pull away from the elongated gripping portion 20. The frame 37 portion of the cover 30 may remain fixedly joined to the elongated gripping section 20, so the frame does not separate from the elongated gripping section 20. The ability of the fins 36 to release from the elongated gripping section 20 may aid in the fins deflecting and contacting each other when the handle is gripped by a user.

The fins 36 may have a height "$h_1$" of about 1.2 mm to about 2.5 mm, for example, about 1.7 mm. The height "$h_1$" may be measured from a top surface 62*j* of the fin 36*j* to the exposed top surface 58 of the elongated gripping section 20. The height "$h_1$" of the fins (for example fin 36*j*) may be greater than or equal to a gap width "$d_1$" between adjacent fins (for example fins 36*i* and 36*j*). The distance "d1" may be measured where the top surface 58 of the elongated gripping section 20 meets the fins 36*i* and 36*j*. The gap width "$d_1$" may be about 0.5 mm to about 1.2 mm, for example about 1 mm. In certain embodiments the fins 36 may have a height to gap width ratio greater than about 1:1, for example the height to gap width ratio may be about 1.6:1. The height to gap width ratio may be as high as about 5:1. The gap width (area between adjacent fins 36) may be substantially free of the elastomeric cover 30. The gap width being substantially free of elastomeric material, the height of the fins and the height to gap width ratio may all facilitate the flow of water and other substances under the user's finger tips and through the fins 36, thus improving the user's grip. The improved flow of water may also improve the ability to clean and rinse the elongated gripping section 20 and the cover 30. about 5:1. The The fins 36 may have a step design having a first section having a first width "$w_1$" that is greater than a second width "$w_2$" of a second section. The first width may be about 1.45 mm to about 2.0 mm and the second width may be about 0.8 mm to about 1.4 mm. The first width "$w_1$" may provide for structural integrity of the fins 36 as well as increase the surface area of the fins 36 that may be joined or bonded to the gripping section 20. The second width "$w_2$" may provide for additional flexibility to facilitate the deflection or bending of the fins 36. The second width "$w_2$" of the fins 36 may also facilitate deflection by decreasing the contact surface area with the user, more force is thus concentrated on the fins 36 causing the fins 36 to deflect to a greater extent without having to grip the handle 12 with more force. In certain embodiments the fins 36 may have a height to first width ratio in the range from about 1:0.8 to about 1:3.2, for example about 1:1.8. In certain embodiments the fins 36 may have a height to second width ratio in the range from about 1:0.6 to about 1:1.7, for example about 1:1.25. The step design may also allow for a greater distance between fins 36 (for example fins 36*i* and 36*j*), as measured between the top surfaces 62*i* and 62*j* of adjacent fins 36*i* and 36*j*. The distance between adjacent fins "$d_2$" may be from about 2 mm to about 3 mm, for example about 2.7 mm.

The height to first width ratio, the height to second width ratio, the height to gap width ratio and the physical properties of the fins 36 (such as hardness and elongation), allow the fins 36 to deflect and contact an adjacent fin when the user grips the cover 30. When the fin 36*i* (for example) deflects and folds over toward an adjacent fin 36*j* (for example) a bridge may be created and the user's hand or fingers may be prevented from contacting the exposed top surface 58 of the elongated gripping section 20 which may contain water or lubricous shaving aids which have a detrimental effect on the user's grip. The fins 36 may provide for improved wet gripping by minimizing the user's contact with water and lubricious substances by allowing the water and lubricious substances to pass under the user's hand and fingers. The rigid material of the elongated gripping portion may facilitate the removal of water and lubricous substances from the spaces between adjacent fins 36, while the tacky properties and the material softness of the fins 36 further improves grip.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Unless otherwise specified the drawings are not drawn to scale, but are generally proportionate and may be relied upon to determine certain dimensional ratios of the various components and structures.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor comprising:

a handle having a substantially rigid elongated gripping section extending along a longitudinal axis of the handle;

an elastomer cover joined to the elongated gripping section, the cover including a plurality of flexible fins having a first width and a second width that is less than the first width, the fins having a shore A hardness of about 20 to about 40 and a height to gap width ratio of about 1:1 to about 2:1.

2. The wet shaving razor of claim 1 wherein the cover includes a frame interconnecting a plurality of end portions of the plurality of flexible fins.

3. The wet shaving razor of claim 1 wherein a plurality of substantially rigid ribs projecting from a top surface of the elongated gripping section.

4. The wet shaving razor of claim 3 wherein the plurality of fins are positioned between the respective rigid ribs.

5. The handle of claim 1 wherein the fins are releasably joined to the elongated gripping section.

6. The handle of claim 5 wherein the fins have a height to gap width ratio of about 1:1 to about 2:1.

7. A handle for a personal grooming article comprising:

a substantially rigid elongated gripping section having a longitudinal axis, a proximal end portion and a distal end portion;

a plurality of substantially rigid ribs projecting from a top surface of the elongated gripping section and extending substantially traverse to the longitudinal axis; and a flexible cover joined to the elongated gripping section, the cover including a plurality of fins and a frame interconnecting a plurality of end portions of the plurality of fins, the plurality of fins defining a plurality of slots extending through the cover, wherein the fins are positioned between respective ribs of the elongated gripping section; and wherein the fins are releasably joined to the elongated gripping section and the fins have a height to gap width ratio greater than about 1:1.

8. The handle of claim 7 wherein the frame is fixidly joined to the elongated gripping section.

9. The handle of claim 7 wherein the cover extends along one or more side walls of the elongated gripping section.

10. The handle of claim 9 wherein the plurality of substantially rigid ribs extend at least partially along at least one of the side walls of the elongated gripping section.

11. The handle of claim 9 wherein the cover has a concave profile along and perpendicular to the longitudinal axis of the elongated gripping section.

12. The handle of claim 7 wherein the fins have a height to gap width ratio of about 1:1 to about 2:1.

13. The handle of claim 7 wherein the fins have a first width and a second width that is less than the first width.

14. The handle of claim 13 wherein the first width is about 1.45 mm to about 2 mm.

15. The handle of claim 13 wherein the second width is about 0.8 mm to about 1.4 mm.

16. The handle of claim 7 wherein a plurality of the fins are angled toward the proximal end portion and a plurality of the fins are angled toward the distal end portion.

17. The handle of claim 16 wherein the plurality of angled fins are bowed.

18. The handle of claim 7 wherein the fins have a shore A hardness of about 20 to about 40.

* * * * *